US008163044B2

(12) United States Patent
Mills

(10) Patent No.: US 8,163,044 B2
(45) Date of Patent: Apr. 24, 2012

(54) FUEL ADDITIVE AND METHOD FOR USE FOR COMBUSTION ENHANCEMENT AND EMISSION REDUCTION

(76) Inventor: John C. Mills, Dallas, TX (US)

( * ) Notice: Subject to any disclaimer, the term of this patent is extended or adjusted under 35 U.S.C. 154(b) by 0 days.

(21) Appl. No.: 12/993,631

(22) PCT Filed: May 20, 2009

(86) PCT No.: PCT/US2009/044711

§ 371 (c)(1),
(2), (4) Date: Nov. 19, 2010

(87) PCT Pub. No.: WO2009/143270

PCT Pub. Date: Nov. 26, 2009

(65) Prior Publication Data

US 2011/0061291 A1 Mar. 17, 2011

Related U.S. Application Data

(60) Provisional application No. 61/054,670, filed on May 20, 2008.

(51) Int. Cl.
*C10L 1/12* (2006.01)

(52) U.S. Cl. ..... 44/457
(58) Field of Classification Search ..... 44/457
See application file for complete search history.

(56) References Cited

U.S. PATENT DOCUMENTS

| | | | | |
|---|---|---|---|---|
| 5,266,082 | A * | 11/1993 | Sanders | 44/357 |
| 2002/0158141 | A1 | 10/2002 | Ryu | |
| 2006/0254130 | A1 | 11/2006 | Scattergood | |
| 2009/0000186 | A1 * | 1/2009 | Sanders et al. | 44/321 |

FOREIGN PATENT DOCUMENTS

| | | |
|---|---|---|
| JP | 2003-64384 | 3/2003 |
| JP | 2009-126874 | 6/2009 |
| KR | 10-2007-0082069 | 8/2007 |
| WO | 2005/097952 | 10/2005 |
| WO | 2007/120262 | 10/2007 |
| WO | 2009/005944 | 1/2009 |

* cited by examiner

*Primary Examiner* — Cephia D Toomer
(74) *Attorney, Agent, or Firm* — Hemingway & Hansen, LLP; Eugenia S. Hansen

(57) ABSTRACT

A fuel additive is disclosed which comprises a suspension of nanoparticle oxides in a fuel miscible liquid carrier, which suspension may be colloidal or otherwise. Methods for enhancing combustion and fuel economy and reducing emissions by employing said fuel additive are also disclosed.

8 Claims, 5 Drawing Sheets

FUEL ADDITIVE AND METHOD FOR USE FOR COMBUSTION ENHANCEMENT AND EMISSION REDUCTION

CROSS REFERENCE TO RELATED APPLICATIONS

This application claims the benefit of U.S. provisional application 61/054,670, filed May 20, 2008.

STATEMENT REGARDING FEDERALLY SPONSORED RESEARCH OR DEVELOPMENT

Not applicable.

TECHNICAL FIELD OF INVENTION

This invention relates to the field of fuel additives comprising oxide nanomaterials and methods for improving fuel economy and reducing emissions by use of said additive.

BACKGROUND OF THE INVENTION

Due to the need to increase the efficiency of automobile fuel, many types of devices and additives have been developed over the years. In Beijing, China (Beijing Yuantong Corporation Ltd) nano-fuel technology has been developed which requires an "ESP" device to be installed in an automobile. This ESP device reportedly converts ordinary fuel completely into nano-fuel, thereby reducing the tail gas of the automobile by more than 50 percent and saving fuel consumption by more than 20 percent.

In most cases, it is preferable to increase fuel efficiency using existing automobile equipment. Fuel additives reported in the past have had some impact on increasing such efficiency, but there is a continuing need for improved fuel additives.

DETAILED DESCRIPTION

Figure 1:
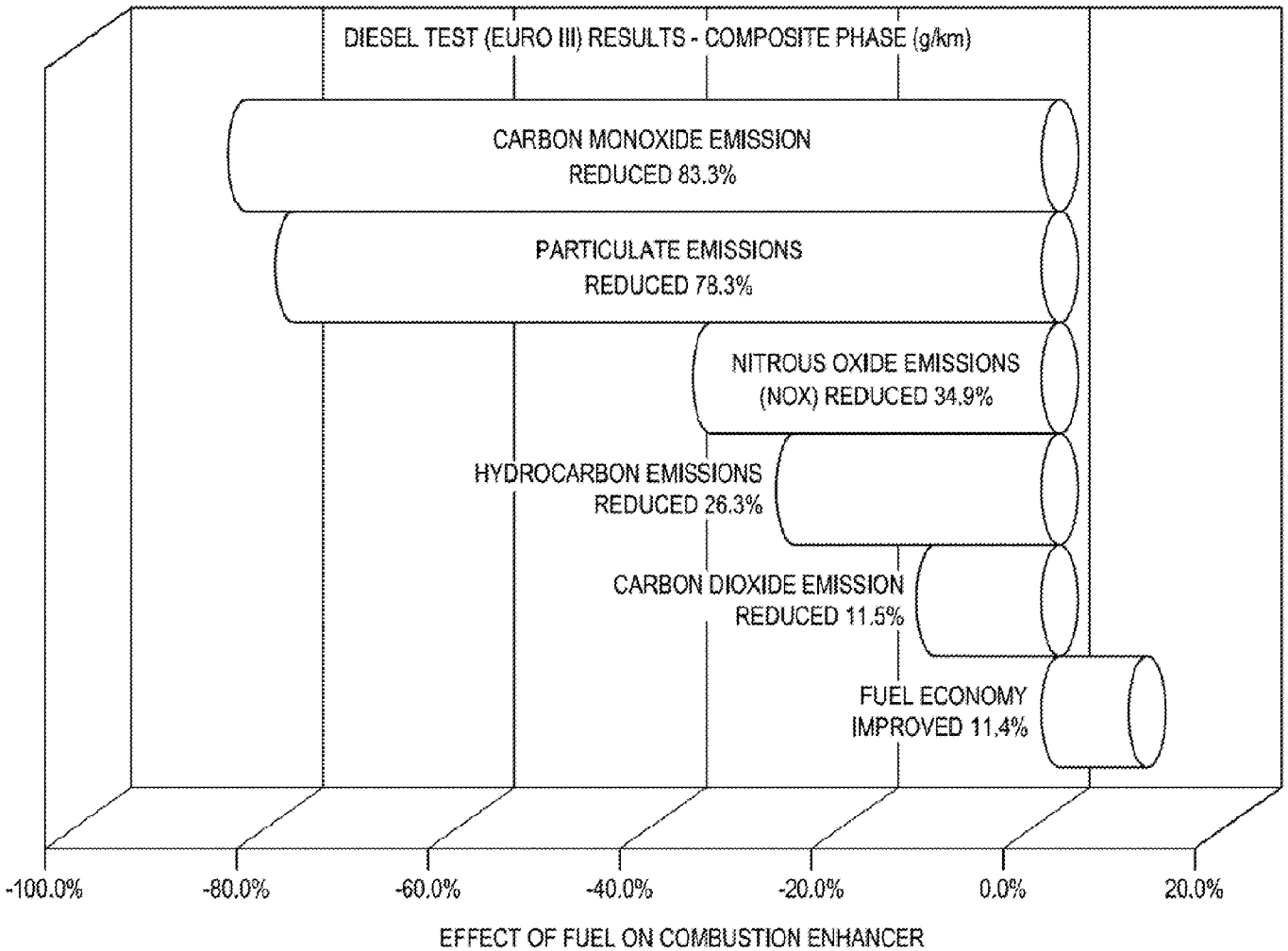
FIG. 1 is a Graph depicting the effect of the fuel additive of the invention on emissions and fuel economy.

The present invention is for a fuel additive which when added to liquid fuel streams of internal and external combustion engines provides for more complete combustion of the fuel by 10-30% without the need for specialized devices or equipment. The fuel additive enables lower internal combustion temperatures; reduced emissions of unburned fuel, reduced emissions of oxides of nitrogen, and reduced emission of carbon monoxide. Further, the fuel additive lowers both the size and quantity of particulate emissions. Further benefits of the invention include reduced internal wear to the engine resulting in a longer service life and reduced maintenance costs and a reduction in the carbon accumulation rate in the combustion chamber. Use of the invention will likely decrease net operating costs, increase the useful life of the engine, and reduce exhaust emissions.

The fuel additive comprises a colloidal or other suspension of nanoparticles comprising metal oxides, for example, oxides of iron, cerium, copper, magnesium and zinc and combinations thereof. Preferably, all of these oxides are employed in combination; however combinations of zinc oxide and magnesium oxide, preferably with another oxide selected from cerium, copper and iron oxide comprise an alternative embodiment. Other oxides could be used that have useful temperatures at which they contribute oxygen to the reaction and then reabsorb it as the combustion chamber of an internal combustion engine cools. Without wishing to be bound by any theory, it is believed that the oxides in combination with the blended carrier scavenge water from the fuel system, utilizing the oxygen component to increase combustion efficiency.

The nanoparticle oxides are commercially available. One commercial source is Nanophase Technology Corporation (Romeoville, Ill.)

The fuel additive preferably comprises a metal oxide component and a carrier component. In the metal oxide component which is about 10 to 20% by weight of the additive, preferably zinc oxide is employed in an amount of 70 to 80% by weight, magnesium oxide in an amount of 10 to 30% by weight, cerium oxide in an amount of 1 to 5% by weight, copper oxide 1 to 5% and ferric oxide 1 to 5% by weight. A preferred exemplary embodiment is a combination of zinc, magnesium and cerium oxides in the following proportion by weight: 75%, 23% and 2%. The remainder of the fuel additive is a fuel miscible liquid preferably a combination of propylene glycol n butyl ether (PnB) and diethylene glycol monomethyl ether (DM) in a preferred ratio of 90:10 by weight.

A preferred embodiment contemplates that the metal oxide used will have extremely small average particle sizes (less than 100 nm; preferably less than 50 nm). As the average particle size decreases, the specific surface area (typically expressed as square meters per gram,) increases dramatically. This causes the material to stay in suspension evenly throughout the liquid phase of the hydrocarbon fuel, as well as in the vapor phase. Further, the small particle size affords the preferred embodiment the ability to react rapidly during the combustion phase contributing oxygen to the combustion reaction, thereby increasing its efficiency.

The colloidal or other suspension is preferably made by ultrasonic mixing of the oxides in a carrier liquid, which produces superior uniformity of the suspension. A procedure for ultrasonic mixing is described in Ultrasonic Production of Nano-Size Dispersions and Emulsions by Thomas Hielscher (Dr. Hielscher GmbH, Warthestrasse 21, 14513 Teltow, Germany, (ENS'05 Paris, France, 14-16 Dec. 2005). The carrier liquid can be any fuel miscible liquid. Preferably the fuel miscible liquid is comparatively less toxic than the fuel and has a flash point above 60 degrees Celsius. Preferred fuel miscible liquids are ethylene glycols, propylene glycol n butyl ether (PnB) and diethylene glycol monomethyl ether (DM). It is preferred to choose a fuel miscible liquid which is exempted from most hazardous materials regulations in order to allow the product to be shipped as non-regulated material.

An example of an ultrasonic mixing technique suitable for the invention follows. One may employ an ultrasonic mixing apparatus (also known as a sonicator), such as model UIP-1000 from Hielscher GmbH, Warthestrasse 21, 14513 Teltow, Germany. The ultrasonic mixing apparatus preferably comprises a sonication chamber connected to an amplification horn attached to an ultrasonic transducer and an ultrasonic generator. The sonication chamber receives a pre-sonicated fuel additive mixture from a continuous mixing tank, which is attached to a positive displacement pump capable of generating pressures in the sonication chamber above 100 psi. The continuous mixing tank serves as a vessel for producing said pre-sonicated fuel additive. Therein, a carrier liquid and oxides are placed and mixed by conventional mechanical dispersion. The ratio of oxides to carrier liquid varies along a wide range from 0.1% by weight to approximately 20% by weight. The pre-sonicated fuel additive is then the cycled through the sonication chamber until sufficient energy has been imparted to disrupt covalent bonds and van der Waals forces, and other forces, which would tend to cause the suspension particles to agglomerate. In the preferred embodiment, approximately 8,000 Joules of energy are imparted per liter of solution at a concentration of approximately 5% metallic oxides to carrier liquid.

In employing the fuel additive, a preferred amount to add to the fuel tank is from about 0.01% to about 0.5% of the fuel. Preferably, less than 0.5% is employed. For example, a vehicle with a 19 gallon tank (72 liters) would preferably receive about 6 ml-80 ml of fuel additive made according to the preceding method.

The fuel additive may be used in a method for reducing net operating costs of the engine. By employing the additive, improved Fuel Economy of about 10 to 30% is demonstrated in diesel and gasoline engines. Use of the fuel additive reduces fouling deposits on valves, injectors and spark plugs, extends the interval between oil changes and reduces engine oil contaminates.

The fuel additive may be used in a method of increasing the useful life of an engine. In one aspect, the fuel additive adds lubricity to fuel and cylinder walls lowering internal friction. In another aspect, it reduces the internal engine stresses by lowering the combustion temperatures and heat stress and delaying onset of pinging or knocking. The exhaust manifold gas temperatures are lowered by the use of the fuel additive.

The fuel additive may be used in motor vehicle engines and will have particular application to the automobile. However, it may also be used in any engine which utilizes hydrocarbon fuels to provide the same or similar advantages such as, without limitation, boilers and ship engines, turbines, fuel oil and coal fired power plants.

Now referring to FIG. 1, a graph showing the effects of using the fuel additive of the invention on emissions and fuel economy is depicted. Carbon Monoxide emission was reduced 83.3%; particulate emissions were reduced 78.3%; Nitrous Oxide emissions (NOx) were reduced 34.9%; hydrocarbon emissions were reduced 26.3%; carbon dioxide emissions were reduced 11.5%; and Fuel Economy improved 11.4%. The formula tested was the preferred embodiment described above: 75% zinc oxide, 23% magnesium oxide and 2% cerium oxide which comprised 18% by weight of the formulation. The balance of the formulation was carrier with PnB being 90% thereof and DM 10% thereof.

Figure 2A:
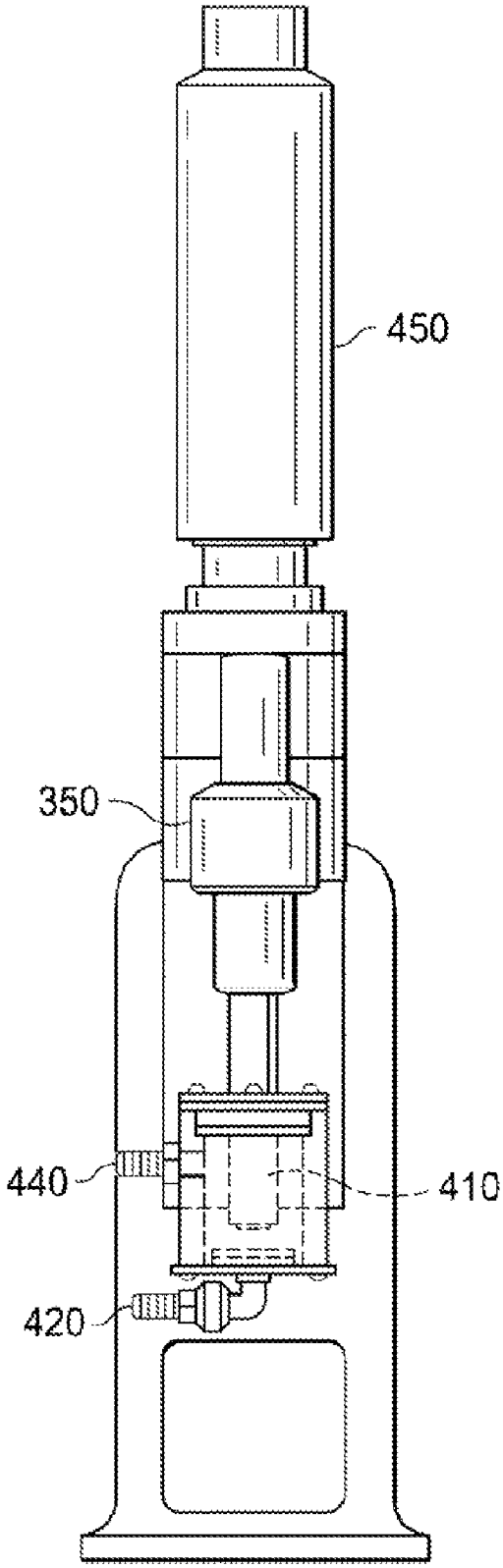
FIGS. 2A-2B depict a UIP-1000 device that can be used to make the subject fuel additive.
Figure 2B:
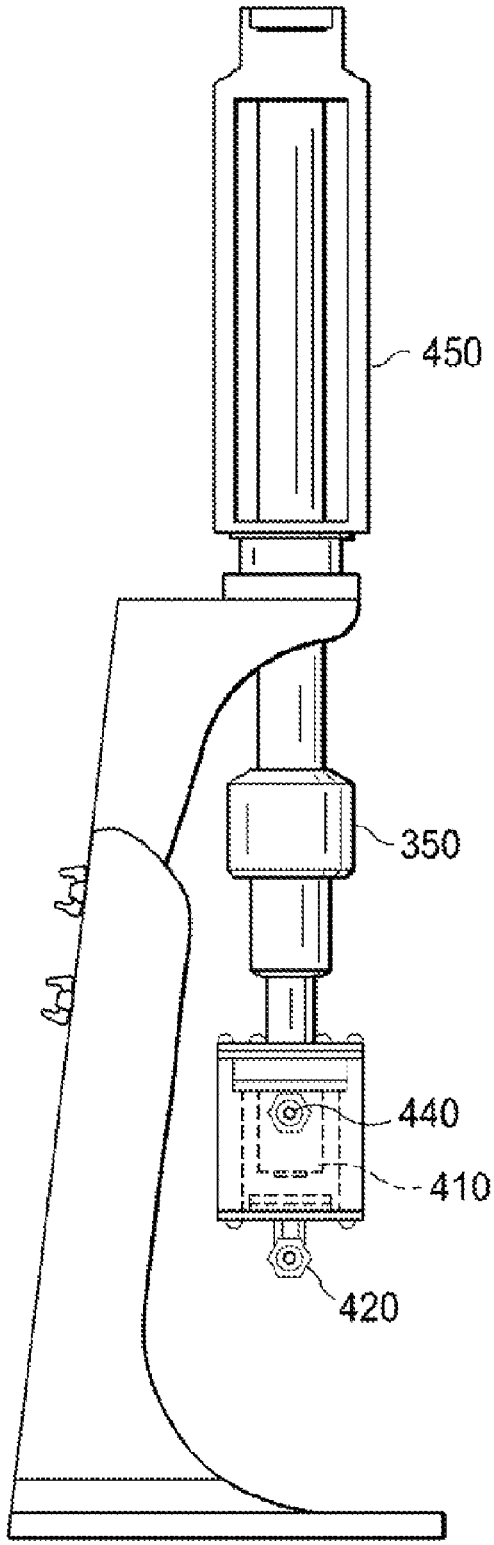

Now referring to FIG. 2A and 2B, which depict a UIP-1000 device that can be used to make the subject fuel additive. FIG. 2A being a front view and FIG. 2B being a side view thereof. Reference numerals shown refer to the same structure as the numerals used and described with respect to FIGS. 3 and 4.

Figure 3:
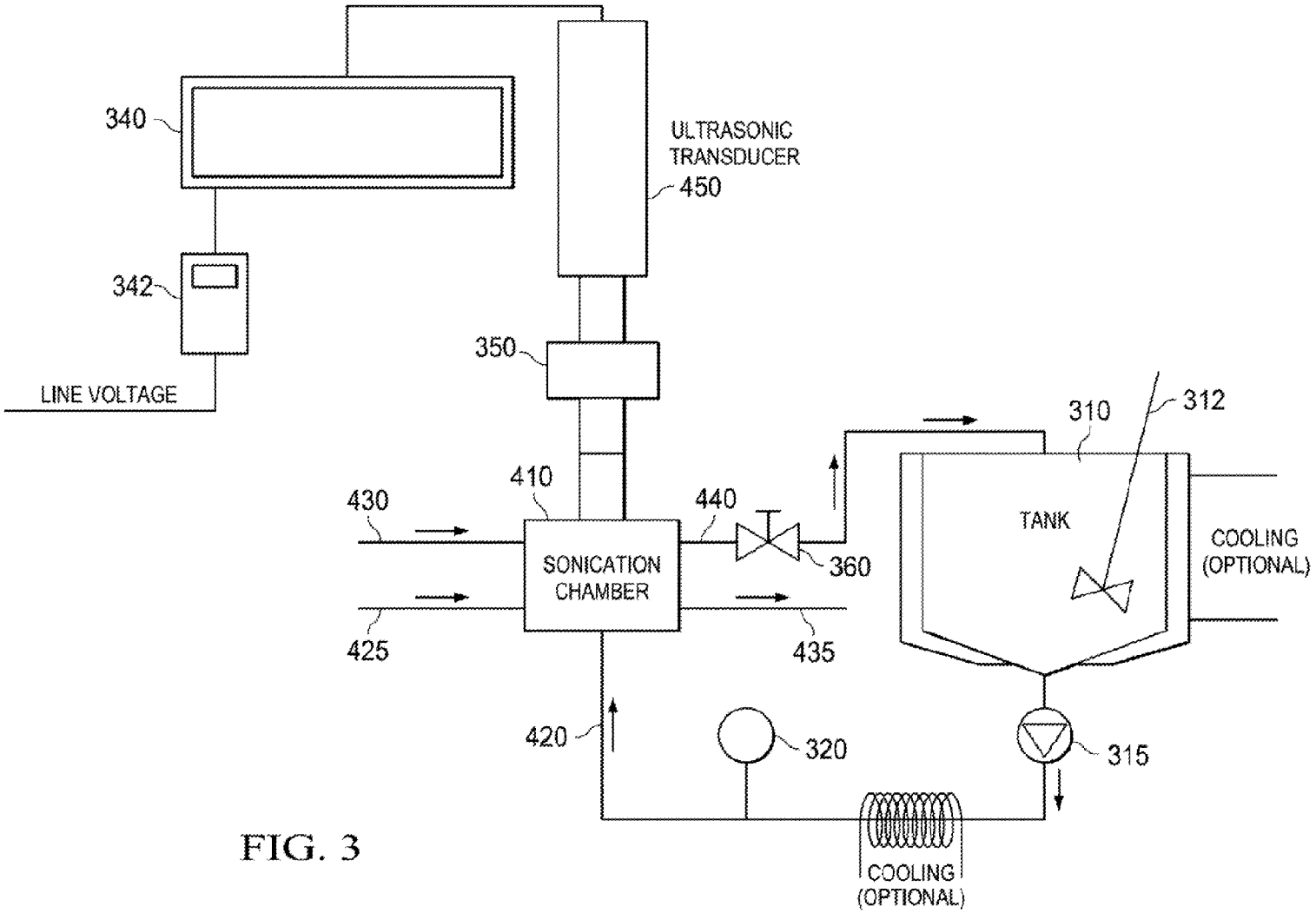
FIG. 3 is a flow chart illustrating a process for making a fuel additive according to the invention.

Now referring to FIG. 3, a flow diagram of the recirculation process and sonication chamber wherein the fuel additive may be made is shown. A mixing tank (310) is used to mix a liquid portion of the invention with a dry portion of the invention. The size of the mixing tank (310) is not critical, but in one embodiment it has been found that a capacity of between 5 and 10 liters, or about eight liters, may be employed with the sonicating device of FIG. 2A-2B. The pre-sonication process may be carried out by placing the carrier (liquid portion) of the invention into the mixing tank (310) and stirring at approximately 50% speed until a vortex develops. The metal oxides (dry portion) of the fuel additive composition may be gradually added to the upper edge of the vortex. Once the dry portion is fully incorporated, the balance of the liquid portion can be added to bring the contents of the tank to the desired batch weight. Once all the ingredients have been incorporated, dispersion time at high speed will be approximately 20 minutes for an 8 liter batch. The preferred disperser blade (312) has a blade diameter equal to about 30-35% of the mixing tank diameter and placed about one blade radius in distance from bottom of mixing tank (310) and about three blade radii in distance from surface of mixture. The preferred tip speed of the disperser blade (312) is about 4750 feet/minute, which can be calculated by multiplying the blade diameter by pi and by the shaft rpm. To obtain this speed, a motor is needed that can handle about 0.0253 HP for every one liter of batch volume. Variations on these specifications will impart the desired properties to the batch. The process can be scaled up or down to impart the desired characteristics to the fuel additive.

The mixing shaft speed is reduced to approximately 50% shaft speed and allowed to circulate the mixture during the sonication process.

Once ingredients are significantly dispersed in mixing tank (310) via mechanical mixing techniques to form a pre-sonication fuel additive, said pre-sonication fuel additive is pumped out of mixing tank (310) by a pump (315) and sent to a sonication chamber (410) where it enters through feed one (420). A temperature and pressure gauge (320) preferably is included in the line between pump (315) and sonication chamber (410) to measure the temperature and pressure of the mixture prior to entering the sonication chamber (410). The process occurring within the sonication chamber (410) is discussed in further detail in FIG. 4. The pump from the tank to the sonication chamber is energized, the water cooling inlet (430) and outlet (435) valves are opened and continually adjusted to maintain the pre-sonicated mixture at a temperature below the 'flash point' of the carrier component of said mixture during the sonication procedure. The pressure/flow control valve (360) can be adjusted to produce a pressure of between 2 and 8 bar, preferably between 3 and 3.5 bar.

The ultrasonic generator (340) is energized and the energy meter (342) is used to adjust the output of the generator to impart 0.5 kWh to 2.0 kWh of energy per kg of the above mixture. The preferable amount of energy is between 1.3 to 1.5 kWh per kg. Variations on these specifications will impart the desired properties to the batch. The output from the ultrasonic generator (340) is received by the ultrasonic transducer (450) where the output is converted to an ultrasonic wave or pulse. An amplification horn (350) may be used to amplify the wave or pulse produced by the ultrasonic transducer (450).

After sonication is completed, the pressure/flow control valve (360) is opened and the formed sonicated mixture is released from sonication chamber (410) where it is returned to the mixing tank (310) or collected from the sonication chamber via outflow means (425). It should be noted that means (425) can serve either as an inflow means (feed two as explained below in connection with FIG. 4) or outflow means. Multiple structures like (425) may be employed and designated for either inflow or outflow to sonication chamber (410). If the sonicated mixture is returned to mixing tank (310), the sonicated mixture may be retrieved through a drain line (not shown) as the fuel additive product, or the process may be repeated until all the mixture within the mixing tank has been sonicated.

Figure 4:
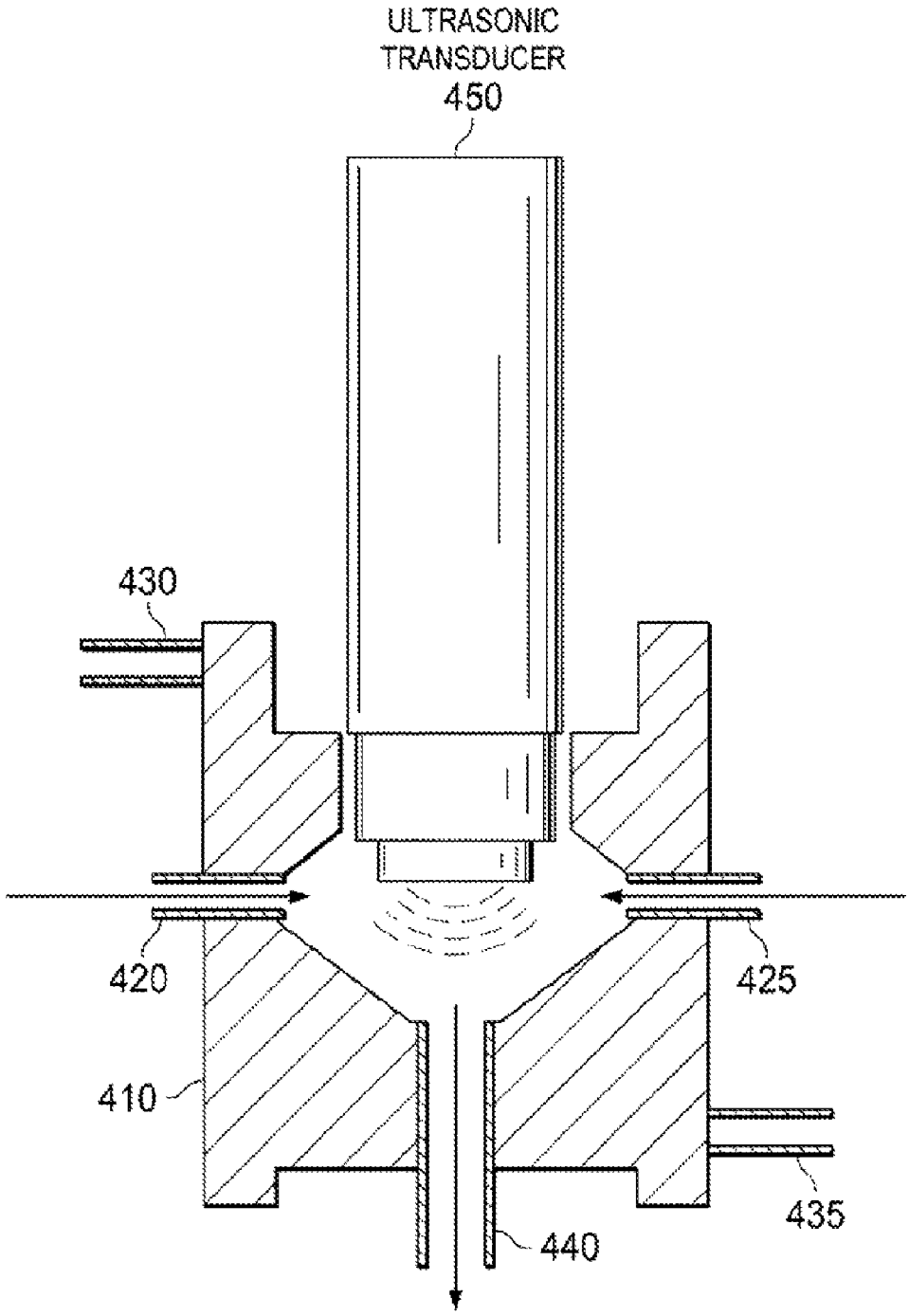
FIG. 4 is a diagram illustrating a sonication process which may be used in making the subject fuel additive.

Now referring to FIG. 4, a diagram of the sonication chamber and the sonication process is depicted. The mixture enters the sonication chamber (410) by way of feed one (420). An optional feed two (425) allows for the addition of other materials that may be needed before, during, or after the sonication process. Feed two (inflow means) (425) may also be used as an additional feed for the mixture to allow increased and faster production volume without tampering with the results of the invention. The sonication chamber (410) can have included a cooling system, the preferred cooling system a water cooling system. The water cooling system, having a water cooling inlet (430) and a water cooling outlet (435), would perform like a common heat exchanger, most preferable like a shell and tube heat exchanger. The cooling system is activated and continually adjusted to maintain a fluid temperature below the 'flash point' of the carrier component of said mixture during the sonication procedure. The ultrasonic transducer (450) then transforms the output received by the ultrasonic generator (340) into ultrasonic waves or pulses used to emulsify, disperse, extract, homogenize, or perform other sonication practices known in the art. Once completed, the pressure/flow control valve (360) is opened and mixture is released through sonication chamber exhaust (440). The sonicated mixture is returned to mixing tank (310) where the finished product may be retrieved or the sonicated mixture may exit the sonication chamber (410) through outflow means (425).

Example 1

Fuel Economy

A series of tests were performed on various gasoline and diesel vehicles ranging in age from model year 1995 to model year 2006. The formula used in these tests was 75% zinc oxide, 23% magnesium oxide and 2% cerium oxide which comprised 18% by weight of the formulation. The balance of the formulation was carrier with PnB being 90% thereof and DM 10% thereof.

Fuel economy improvements were noted in all vehicles and ranged from an 11% to 18% improvement. Improvement was measured on each vehicle by a "with and without test" initially, the vehicle was driven over an approximately 52 Mile Hwy course at constant speed and the fuel consumption was measured. The test was then replicated after addition of the additive. After addition of the additive the vehicle was driven approximately 30 miles, refilled and driven over the above-mentioned course. Afterwards, the fuel economy was measured and the percentage change was recorded. Additionally, many of these vehicles were tested for changes in emissions characteristics. Emissions were measured before and after and the change recorded. In some cases emissions were measured by the standard dynamometer test used by the state of Texas when renewing a vehicle's "safety inspection sticker." Other vehicles were tested using hand-held exhaust gas analyzers. Most frequently, the model 350 from Testo AG Lenzkirch Germany was employed.

Example 2

Wear Metal Content of Oil

Detection of wear metal in oil is indicative of engine wear. (Blackstone Laboratory, Fort Wayne, Ind.) Engine oil was recovered from vehicles, which had been testing the additive over a period of at least 5000 miles. The samples were analyzed and the results compared to known averages for such metals in the vehicles being tested. The reduction in wear metal content in the test engines vs. typical engines ranged from 16 to 24%.

Example 3

Reduction of Exhaust Emissions (Pollution)

A field test was conducted to determine the effect of the fuel additive on exhaust emissions. A test was conducted using a chassis dynamometer with exhaust gas trapping and concentrating equipment and particulate filters. The test was run using the Euro III testing protocol (European Union Directive 98/69/EC Article 2 (2)). The vehicle was a 2006 Nissan pickup with a 21/2 liter diesel engine with a standard emissions control system. The vehicle had approximately 55,000 km of use recorded on the odometer. The test simulated both urban and freeway driving conditions. The standard Euro III algorithms were used to compute a composite value. The results of the test are depicted in FIG. 1 and were as follows:

increase in fuel economy, 11.5%;
reduction in carbon monoxide emissions, 83%:
reduction in combined nitrous oxide emissions, 35%:
reduction in hydrocarbon emissions, 26%:
reduction in particulate emissions, 78%,

I claim:

1. A fuel additive consisting of a combination of zinc oxide nanoparticles in an amount of 70 to 80% by weight, magnesium oxide nanoparticles in an amount of 10 to 23% by weight, cerium oxide nanoparticles in an amount of 1 to 5% by weight, copper oxide nanoparticles in an amount of 1 to 5% by weight and ferric oxide nanoparticles in an amount of 1 to 5% by weight.

2. A fuel additive consisting of a combination of nanoparticles of zinc, magnesium and cerium oxides in the following proportion by weight: 75%, 23% and 2%.

3. The fuel additive of claim 1, wherein the average particle size of said nanoparticles is less than 50 nm.

4. The fuel additive of claim 2, wherein the average particle size of said nanoparticles is less than 50 nm.

5. A method for reducing emissions of pollutants generated from the combustion of a hydrocarbon fuel, comprising adding to said hydrocarbon fuel a fuel additive, consisting of a combination of zinc oxide nanoparticles in an amount of 70 to 80% by weight, magnesium oxide nanoparticles in an amount of 10 to 23 by weight, cerium oxide nanoparticles in an amount of 1 to 5% by weight, copper oxide nanoparticles in an amount of 1 to 5% by weight and ferric oxide nanoparticles in an amount of 1 to 5% by weight.

6. A method for reducing emissions of pollutants generated from the combustion of a hydrocarbon fuel, comprising adding to said hydrocarbon fuel a fuel additive consisting of a combination of nanoparticles of zinc, magnesium and cerium oxides in the following proportion by weight: 75%, 23% and 2%.

7. A method for improving the fuel economy of hydrocarbon fuel combusted in an engine, comprising adding to said hydrocarbon fuel a fuel additive consisting of a combination of zinc oxide nanoparticles in an amount of 70 to 80% by weight, magnesium oxide nanoparticles in an amount of 10 to 23% by weight, cerium oxide nanoparticles in an amount of 1 to 5% by weight, copper oxide nanoparticles in an amount of 1 to 5% by weight and ferric oxide nanoparticles in an amount of 1 to 5% by weight.

8. A method for improving the fuel economy of hydrocarbon fuel combusted in an engine, comprising adding to said hydrocarbon fuel a fuel additive consisting of a combination of nanoparticles of zinc, magnesium and cerium oxides in the following proportion by weight: 75%, 23% and 2%.

* * * * *

UNITED STATES PATENT AND TRADEMARK OFFICE

CERTIFICATE OF CORRECTION

PATENT NO. : 8,163,044 B2
APPLICATION NO. : 12/993631
DATED : April 24, 2012
INVENTOR(S) : Mills It is certified that error appears in the above-identified patent and that said Letters Patent is hereby corrected as shown below:

In the Specifications:

Col. 2, line 36, replace "gram,)" with -- gram) --
Col. 3, line 50, replace "cerium oxide which" with -- cerium oxide, which --
Col. 5, lines 7-8, replace "can have included a cooling system," with -- can include a cooling system; --
Col. 5, line 8, replace "system a" with -- system is a --
Col. 5, line 34, replace "cerium oxide which" with -- cerium oxide, which --

Signed and Sealed this
Twenty-seventh Day of August, 2013

Teresa Stanek Rea
*Acting Director of the United States Patent and Trademark Office*